US005106685A

United States Patent [19]

Specker

[11] Patent Number: 5,106,685

[45] Date of Patent: * Apr. 21, 1992

[54] PROCESS FOR MANUFACTURING A SMOOTH POLYESTER YARN AND YARN SO OBTAINED

[75] Inventor: Hugo Specker, Sempach Stadt, Switzerland

[73] Assignee: Rhone-Poulenc Viscosuisse SA, Emmenbrücke, Switzerland

[ * ] Notice: The portion of the term of this patent subsequent to Aug. 21, 2007 has been disclaimed.

[21] Appl. No.: 377,845

[22] PCT Filed: Oct. 6, 1988

[86] PCT No.: PCT/CH88/00179

§ 371 Date: Jun. 8, 1989

§ 102(e) Date: Jun. 8, 1989

[87] PCT Pub. No.: WO89/03437

PCT Pub. Date: Apr. 20, 1989

[30] Foreign Application Priority Data

Oct. 30, 1987 [CH] Switzerland ..... 3997/87

[51] Int. Cl.[5] ..... D02J 1/22; D01D 5/12; D02G 3/00

[52] U.S. Cl. ..... 428/364; 264/210.8; 264/289.6; 264/290.5

[58] Field of Search ..... 428/364; 264/210.8, 264/289.6, 290.5

[56] References Cited

U.S. PATENT DOCUMENTS

| | | | |
|---|---|---|---|
| 3,651,198 | 3/1972 | Mitsuishi et al. | 264/290.5 |
| 3,770,866 | 11/1973 | Sakata et al. | 264/289.6 |
| 3,816,486 | 6/1974 | Vail | 264/289.6 |
| 4,195,052 | 3/1980 | Davis et al. | 264/210.8 |
| 4,950,539 | 8/1990 | Specker et al. | 428/364 |

FOREIGN PATENT DOCUMENTS

WO88/03185 5/1988 PCT Int'l Appl. .

*Primary Examiner*—George F. Lesmes
*Assistant Examiner*—James D. Withers
*Attorney, Agent, or Firm*—Felfe & Lynch

[57] ABSTRACT

In a process for manufacturing a smooth, dimensionally stable, shrink-resistant polyester filament yarn, the starting product is a polyester POY. The polyester POY (5*a*) is cold-stretched (5*b*) in a stretching ratio of 1.8 to 2.5 and then relaxed with an advance of approximately 3 to 10%. The yarn so obtained has an initial modulus of 600 to 1200 cN/tex, a reversibility limit greater than >8 cN/tex, and an extensibility less than <20%. It is used as a high-strength polyester yarn whenever dimensional stability is essential.

7 Claims, 3 Drawing Sheets

PROCESS FOR MANUFACTURING A SMOOTH POLYESTER YARN AND YARN SO OBTAINED

The invention relates to a process for the manufacture of a cold drawn, flat polyester filament yarn made of POY with an intrinsic viscosity of 0.6 to 0.9 dl/g as well as a polyester filament yarn manufactured according to the process.

A flat multiple filament yarn is not a textured filament yarn which retain his uncurled flat form even after the boiling in water.

Polyester is a thermoplast made from at least 85 weight percent terephtalic acid and ethylene glycol.

Polyester-POY (Partially Oriented Yarn) stands for a polyester yarn which was drawn, i.e. spun, from the spinning nozzle at a speed of appr. 2,500 to 3,500 m/min. The winding can be performed directly by means of a spooler or a pair of rolls can be interposed. The pair of rolls turns at the same or at a slightly lower speed than the spooler which serves to control the yarn tension in order to improve the winding structure. The exact spinning speed for a good POY depends on different spinning conditions, in particular on the fibril titer. For example, a fibril titer of 1 dtex should be used for the lower limit and a fibril titer of 10 dtex applies more to the upper limit.

Cold drawing signifies a drawing at yarn temperatures which are significantly below the glass conversion temperature of polyester, that is significantly below 85° C. For example, in order to perform a drawing the feeding roll can either be not heated or have a temperature up to 70° C.

A homogenous cold-drawing is to imply that the draw-ratio must be selected so high as to avoid undrawn or insufficiently drawn parts in the drawn yarn, i.e. drawn under the draw ratio selected, which can be recognized from the Uster % which should be less than 1.4. For POY of the speed range indicated, this means, according to the spinning speed, the draw ratio must be at least 1.8.

Hot relaxation means a length decrease of the yarn caused by a heat treatment involving temperatures above the glass conversion temperatures. The amount of length decrease is determined by what is referred to as the overfeed [VE]:

$$\% \ VE = \frac{V_L - V_A}{V_A} \times 100$$

The percentage of shrinkage or relaxation [S] is related to the overfeed as follows:

$$S \ \% = \frac{VE \times V_A}{V_L} = \frac{VE \times 100}{100 + VE}$$

VE = overfeed $V_L$ = Speed of feeding rolls $V_A$ = Speed of winding rolls

S = Relaxation

It is known to manufacture cold-drawn polyester yarns from POY which is spun with more than 3,500 m/min (JP-A-53-14 37 28).

Conventionally known, drawn yarns made of polyester-POY have the disadvantage that a flat structure made thereof is not thermostable during a tension-free or yarn-tension-free treatment in boiling water or hot air. This undesirable property during further manufacture, i.e. after a tension-free, thermal treatment, is indicated by a pronounced relaxation shoulder in the force-elongation-diagram.

It is the object of the invention to provide a process for manufacturing a polyester filament yarn which does not exhibit these disadvantages and moreover, has a high initial modulus, high strength and a low shrinkage.

The object is achieved in accordance with the invention in that the POY is cold-drawn at a constant draw ratio between 1.8 and 2.5 and subsequently relaxed at a constant overfeed between 3 and 10%.

The invention will be best understood from the following description of the drawings wherein.

Figure 1:
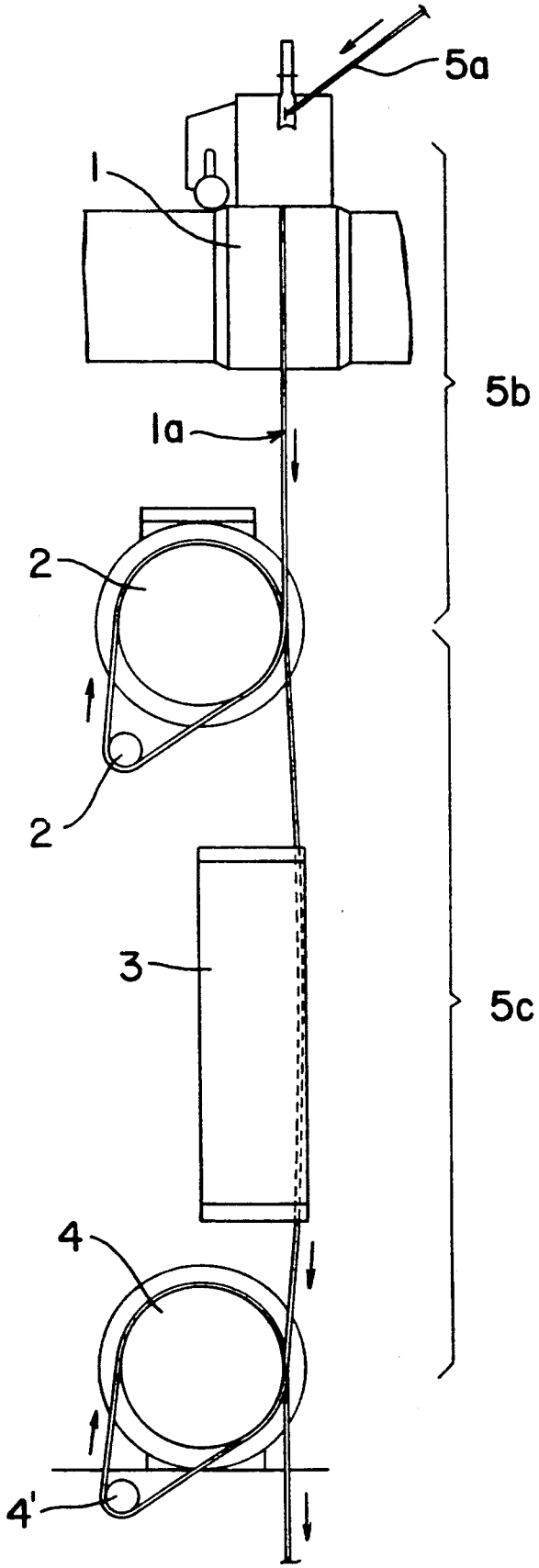
FIG. 1 shows a schematic block-diagram of the process according to the invention.

Surprisingly, thermal influences caused only slight dimensional changes. After the hot water treatment, a relatively high initial modulus is retained. This was the first time to succeed in manufacturing a dimensionally stable, high-strength filament yarn from polyester by employing a polyester-POY, using an intrinsic viscosity of 0.6 to 0.9 dl/g obtained through cold drawing, followed by a subsequent hot relaxation. A viscosity of 0.62 to 0.82 dl/g, particularly 0.67 dl/g measured at 25° C. in a 1:1 mixture of phenol/tetrachloroethane, is a preferred viscosity range for the initial material.

A relaxation in a dry medium has several advantages as compared to a wet relaxation. The manufactural process is significantly less complicated, i.e. a drying stage is not required, energy can be saved, no machinery fouling, no overload of the air conditioning system by steam.

As compared to the initial material, the result are threads/yarns exhibiting only insignificant changes in their strength-elongation property during continuing thermal treatment. Such an effect could not be anticipated.

A high initial modulus of greater than 800 cN/tex has the advantage to significantly reduce the risk of damage by yarn tension peaks during the manufacture of textile flat structures as they are known in weaving and knitting processes. In many cases, a yarn with a low initial modulus will no more meet the requirements called for by the high speeds of the processing machines. Hence, it is advantageous to manufacture an initial modulus of 800 to appr. 1200 cN/tex and higher with a relatively low-viscous initial polymer. At the same time, a reversibility limit over 9 cN/tex is to compensate the yarn tension peaks due to the further manufacturing process. Such yarn tension peaks lead to faults in the flat structure and consequently reduce the production efficiency. Therefore, the aim is a highest possible reversibility limit.

It is also advantageous to select a reference elongation of less than 9% at 45 cN/tex (reference elongation D45). A tension-free hot water treatment at appr. 98° C. must ensure that this reference elongation involves the smallest possible change. A thus obtained dimensional stability permits advantageous further processing conditions.

This requirement is met, if the total sum of the reference elongations (D45) before and after the boiling water treatment is less than 20%, particularly less than 18%, preferably less than 17%. It is advantageous to select as a reference elongation an elongation which is measured at 45 cN/tex and can be considered as a value to characterize the force/elongation curve of the yarn.

The yarn in accordance with the invention is to simultaneously meet the following requirements:

It must have an initial modulus of at least 800 cN/tex, especially from 800 to 1200 cN/tex; a reversibility limit of 8 to 12 cN/tex, especially 8 to 10 cN/tex; a breaking elongation of less than 18%, preferably between 14 and 16%; a boiling shrinkage of 0 to 2.8%; especially 0 to 2%; an intrinsic viscosity of 0.60 to 0.90 dl/g, especially 0.63 to 0.70 dl/g.

Such a yarn must also exhibit a thermal shrinkage at 160° C. of less than 7%.

Moreover, the following physical properties should result from a yarn-tension-free, i.e. tension-free hot water treatment at 98° C:

| | |
|---|---|
| initial modulus | >600 cN/tex |
| reversibility limit | >8 cN/tex |
| elongation | <19% |

The yarn which has shrunk as far as possible has the advantage that, in case of a spool dyeing, it can directly be twisted onto a perforated dye tube, without steaming and respooling.

The invention shall be explained based on examples.

A polyester POY with an intrinsic viscosity of 0.67 dl/g is used as an initial material for all examples.

EXAMPLE 1

An appropriate mass of polyethylene terephtalate was molten in an extruder at 285° C. and lustrous round-spun to a polyester-POY with a titer dtex 140 f 24 by nozzles at 3100 m/min, cold-drawn on a drawing machine at a ratio of 1:2.12 using a drawing pin and subsequently continuously relaxed at an overfeed of 5%. A plate-heater with a length of 20 cm was used for relaxation at 225° C. Subsequently, the yarn was subject to an intermingling corresponding to a turbulence intensity of appr. 20 knots/m. The feeding speed before the drawing is 203.7 m/min, before the relaxation zone 431.8 m/min, the drawing speed which can be determined after the relaxation is at 411.2 m/min. The resulting yarn is put on a spool.

EXAMPLES 2 and 3

Variants according to table I.

Table 2 combines the test conditions of examples 1 to 3.

TABLE 1

| | | Example 1 | Example 2 | Example 3 |
|---|---|---|---|---|
| POY-Titer | dtex | 140 f 24 | 190 f 24 | 300 f 30 |
| Nominal titer | dtex | 70 f 24 | 90 f 24 | 150 f 30 |
| draw ratio | | 1:2,12 | 1:2,15 | 1:2,10 |
| heater temp in | °C. | 225 | 235 | 230 |
| cm | | 20 | 20 | 48 |
| feed speed before drawing | m/min | 203,7 | 204,6 | 290,0 |
| feed speed before relaxation | m/min | 431,8 | 440,0 | 609,0 |

TABLE 1-continued

| | | Example 1 | Example 2 | Example 3 |
|---|---|---|---|---|
| winding speed | m/min | 411,2 | 419,0 | 580,0 |

Figure 2:
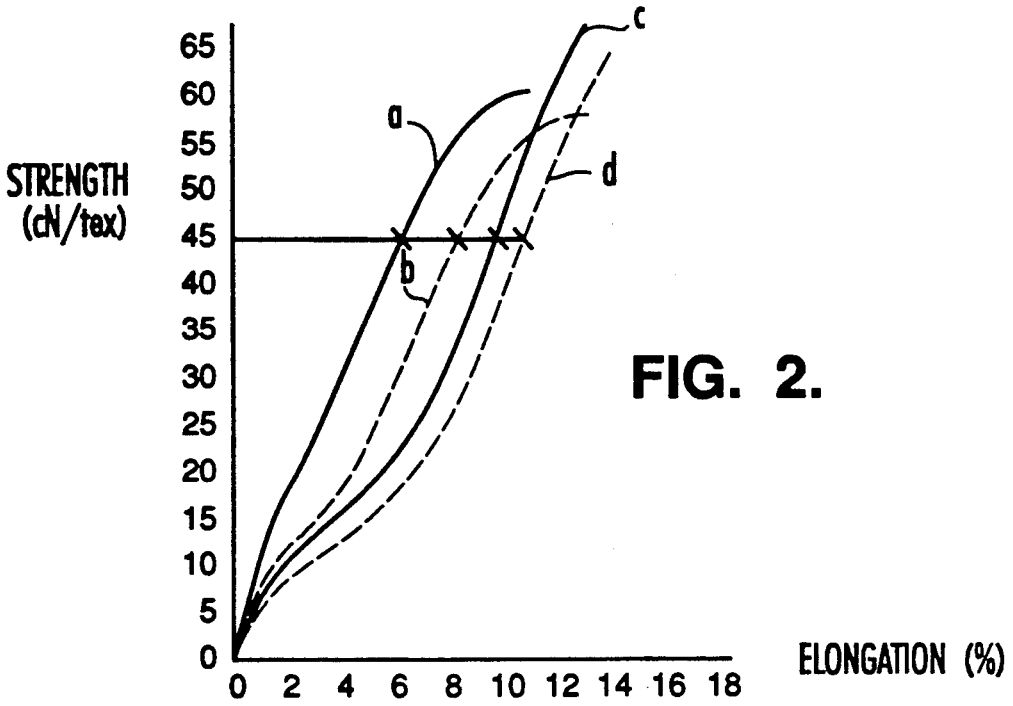
FIG. 2 shows strength-elongation curves of polyester yarns, PES dtex 70 f 24, in accordance with the present invention.
Figure 3:
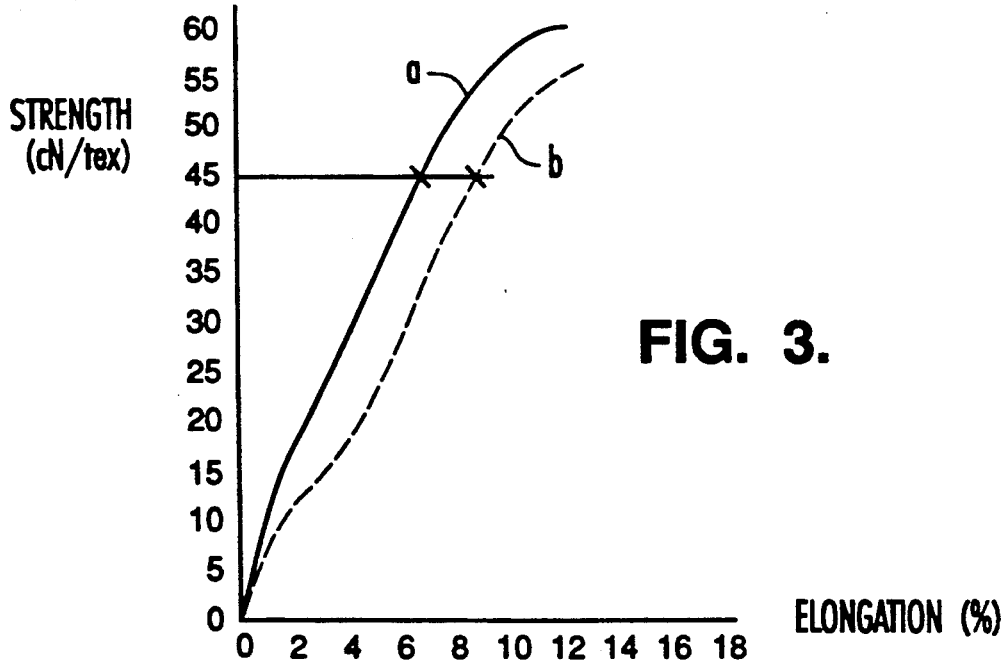
FIG. 3 shows strength-elongation curves of polyester yarns, PES dtex 90 f 24, in accordance with the present invention.
Figure 4:
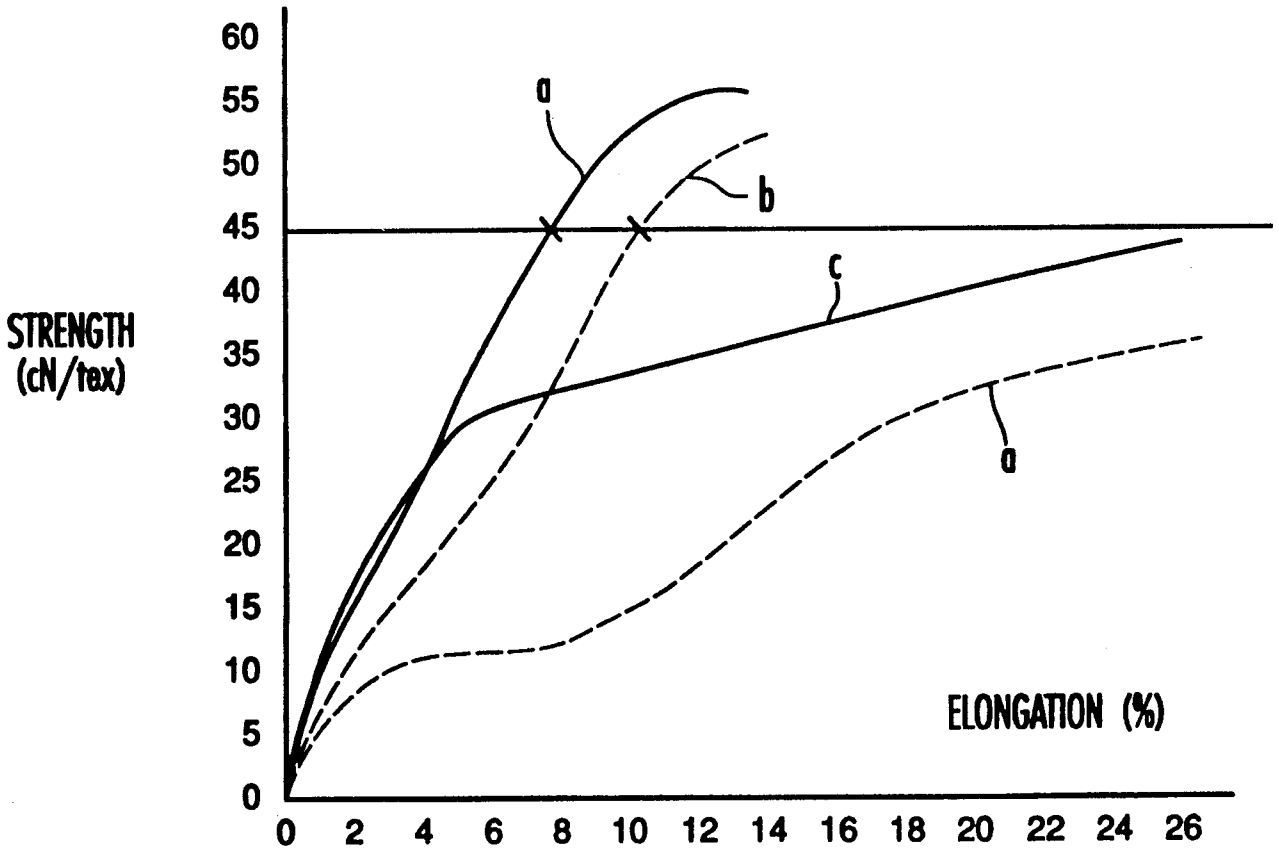
FIG. 4 shows strength-elongation curves of polyester yarns, PES dtex 150 f 30, in accordance with the present invention.

The results are the measured values as represented in table 2 as well as the strength/elongation curves as represented in the diagram of FIGS. 2-4. However, it must be taken into account that it is imperative to perform measurements on a tension-free yarn treated for 15 minutes in boiling water in addition to examinations of an untreated yarn in order to characterize the yarn according to the invention.

The polyester filament yarns in accordance with the invention are described by their characteristic force/elongation curves of FIGS. 2-4.

FIG. 1—A diagrammatic representation of the process in accordance with the invention FIG. 2 *a-d*—Strength/elongation curves a) PES dtex 70 f 24 filament yarn in accordance with the invention b) After a tension-free treatment of the yarn in boiling water according to a)

c) PES (comparison)

d) After tension-free treatment of yarn in boiling water according to c)

FIG. 3 *a+b*—Strength/elongation curves a) PES dtex 90 f 24 in accordance with the invention b) After tension-free treatment of the yarn in boiling water according to a)

FIG. 4 *a-b*—Strength/elongation curves a) PES dtex 150 f 30 b) After tension-free treatment of the yarn in boiling water according to a)

c) PES dtex 167 f 30 no shrinkage (comparison)

d) After tension-free treatment of the yarn in boiling water according to c)

Reference number 1 in FIG. 1 refers to a first feeding unit 1. A second feeding unit 2 with a separator roll 2' is disposed downstream of feeding unit 1. A heater 3 is disposed between feeding unit 2 and drawing unit 4 having a separator roll 4', followed by a winding unit. An undrawn polyester POY 5*a* is taken up by feeding unit 1 and via a drawing pin 1*a* of feeding unit 2 cold-drawn in drawing zone 5*b*. Drawing unit 4 operates at a lower speed than feeding unit 2 which causes the drawn yarn with an adjustable advance to pass through heater 3 in relaxation zone 5*c*. The result is a hot-relaxed yarn with properties in accordance with the inventions.

From FIG. 2 it can be gathered that, for example, the total of the 45 cN/tex reference elongations of the yarn according to the invention is less than 18% before and after an additional hot water treatment. For all comparable yarns, this value exceeds 18%. This means that in the entire measuring range of the strength/elongation curve, the total of the reference elongations are smaller before and after the mentioned hot water treatment as compared to known polyester filament yarns. This characteristic feature imparts to the polyester yarn according to the invention its unique property which makes it suitable for the use as dimensionally stable, high-strength yarn.

FIG. 3 shows basically the same curve display as does FIG. 2 at higher titer.

In FIG. 4 curves a and b are slightly flatter. Known polyester yarns drawn from POY exhibit after the tension-free treatment in boiling water a significantly more pronounced shrinkage curve (d); moreover, the strength values are distinctly below the level of the yarn according to the invention.

For a better overview, the results are combined in the following table II. [A] signifies untreated yarn from spool; [B] yarn values after tension-free treatment in boiling water.

TABLE II

| Examination | | Example 1 | | Example 2 | | Example 3 | | comparison 1 | | comparison 2 | |
|---|---|---|---|---|---|---|---|---|---|---|---|
| | | [A1] | [B1] | [A2] | [B2] | [A3] | [B3] | [A4] | [B4] | [A5] | [B5] |
| Titer | dtex | 68,2 | 69,9 | 91,4 | 95,3 | 145,0 | 146,4 | 69,9 | 77,6 | 165,6 | 180,8 |
| Tensile strength | N | 4,2 | 4,1 | 5,6 | 5,4 | 8,6 | 8,4 | 4,1 | 5,1 | 7,6 | 6,9 |
| Strength | cN/tex | 61,6 | 59,2 | 61,3 | 56,8 | 59,3 | 57,4 | 59,2 | 65,7 | 45,9 | 38,2 |
| Breaking elongation | % | 11,7 | 13,5 | 12,9 | 13,3 | 13,9 | 15,2 | 13,5 | 14,6 | 29,3 | 32,6 |
| Cm (mechanical constant) | | 210,6 | 217,6 | 220,1 | 207,0 | 221,1 | 223,7 | 217,6 | 251,1 | 248,4 | 217,9 |
| Absolute modulus | N | 77,8 | 54,5 | 96,9 | 86,2 | 147,5 | 113,8 | 54,5 | 40,0 | 178,8 | 86,4 |
| Titer-referred modulus | N/tex | 11,4 | 7,8 | 10,6 | 9,0 | 10,2 | 7,8 | 7,8 | 5,2 | 10,8 | 4,8 |
| Abs. reversibility limit | c/N | 85,0 | 63,0 | 102,0 | 75,0 | 157,5 | 122,5 | 63,0 | 57,0 | 217,5 | 135,5 |
| titer-ref. revers. limit | cN/tex | 12,5 | 9,0 | 11,2 | 7,9 | 10,9 | 8,4 | 9,0 | 7,3 | 13,1 | 7,5 |
| Thermal shrinkage 160° | % | 5,3 | — | 5,4 | — | 6,7 | — | — | — | 13,8 | — |
| Boiling shrinkage | % | 2,3 | — | 2,3 | — | 2,5 | — | — | — | 9,3 | — |
| Entanglement | Kn/m | 13,3 | — | 9,1 | — | 22,1 | — | — | — | 18,8 | — |
| 45 cN/tex-reference elongation | % | 6,6 | 8,8 | 6,9 | 9,1 | 8,0 | 10,6 | 10,2 | 11,6 | >26 | >30 |
| 45 cN/tex Ref. (Total A + B) | % | 15,4 | | 16,0 | | 18,6 | | 21,8 | | >56 | |

The yarn in accordance with the invention is particularly suitable for sewing threads, sewing or knitting yarns for clothing textiles, fillings for Raschel article and as high modulus-low-shrinkage yarn for half-technical articles as for examples light coating fabrics. The yarn can also be used for covering tarpaulins and curtains.

I claim:

1. Process for manufacturing a cold-drawn, flat polyester filament yarn from a POY with an intrinsic viscosity of 0.6 to 0.9 dl/g wherein the POY is homogeneously cold-drawn at a constant draw ratio between 1.8 and 2.5 and subsequently relaxed at a constant overfeed between 3 and 10%.

2. Process in accordance with claim 1, wherein the relaxation is performed in a dry medium.

3. A flat polyester filament yarn, manufactured from a cold-drawn polyester POY with an intrinsic viscosity of 0.63 to 0.9 dl/g, wherein the filament yarn has an initial modulus of >800 cN/tex.

4. Polyester filament yarn in accordance with claim 3, wherein the reference elongation (D45) is <9% at 45 cN/tex.

5. Polyester filament yarn in accordance with claim 4, wherein the total of the reference elongation (D45) of an untreated filament yarn and of a filament yarn treated tension-free in hot water is <20 %.

6. Polyester filament yarn in accordance with claim 5, wherein the filament yarn simultaneously complies with the following requirements after a yarn-tension-free treatment in boiling water:

| | |
|---|---|
| initial modus | 800–1200 cN/tex |
| reversibility limit | 8–12 cN/tex |
| elongation | 14–18% |
| boiling shrinkage | 0–2.8% |

7. Polyester filament thread in accordance with claim 6, wherein the breaking elongation is <18% and the thermal shrinkage at 160° C. is <7% and the boiling shrinkage is <3%.

* * * * *